US009714148B2

(12) United States Patent
Takahashi et al.

(10) Patent No.: US 9,714,148 B2
(45) Date of Patent: Jul. 25, 2017

(54) IMAGE FORMING APPARATUS

(71) Applicant: CANON KABUSHIKI KAISHA, Tokyo (JP)

(72) Inventors: Keita Takahashi, Abiko (JP); Shinnosuke Iwadate, Toride (JP); Teruhito Kai, Kashiwa (JP); Hiroto Nishihara, Tsukuba (JP); Kenzo Kumagai, Toride (JP); Hiromi Shimura, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/751,863

(22) Filed: Jun. 26, 2015

(65) Prior Publication Data

US 2016/0012320 A1 Jan. 14, 2016

(30) Foreign Application Priority Data

Jul. 9, 2014 (JP) ..... 2014-141365
Jun. 16, 2015 (JP) ..... 2015-121169

(51) Int. Cl.
*B65H 7/20* (2006.01)
*B65H 1/04* (2006.01)
(Continued)

(52) U.S. Cl.
CPC ..... *B65H 7/20* (2013.01); *B65H 1/04* (2013.01); *B65H 7/02* (2013.01); *G03G 15/02* (2013.01); *G03G 15/55* (2013.01); *G03G 15/6514* (2013.01); *G03G 15/6594* (2013.01); *B65H 2405/324* (2013.01); *B65H 2407/21* (2013.01); *B65H 2511/10* (2013.01); *B65H 2511/11* (2013.01); *B65H 2511/12* (2013.01); *B65H 2511/414* (2013.01); *B65H 2551/27* (2013.01); *B65H 2557/12* (2013.01);
(Continued)

(58) Field of Classification Search
USPC ..... 358/1.15
See application file for complete search history.

(56) References Cited

U.S. PATENT DOCUMENTS 4,998,216 A * 3/1991 Hino ..... G06K 15/16 271/9.09
5,689,759 A * 11/1997 Isemura ..... G03G 15/6514 271/171

(Continued)

*Primary Examiner* — Ngon Nguyen
(74) *Attorney, Agent, or Firm* — Fitzpatrick, Cella, Harper & Scinto

(57) ABSTRACT

An image forming apparatus, including: a decision unit configured to decide a size of a recording material on a manual feed tray; a storage unit configured to store the size of the recording material decided by the decision unit when the image forming apparatus is shifted from a first mode in which power is supplied to the decision unit to a second mode in which the power is not supplied to the decision unit; a display unit configured to display information; and a control unit configured to cause the display unit to display a screen for confirming the size of the recording material on the manual feed tray in a case where the size of the recording material decided by the decision unit when the apparatus is shifted from the second mode to the first mode does not match the size of the recording material stored in the storage unit.

13 Claims, 10 Drawing Sheets

(51) Int. Cl.

| | |
|---|---|
| ***B65H 7/02*** | (2006.01) |
| ***G03G 15/02*** | (2006.01) |
| ***G03G 15/00*** | (2006.01) |

(52) U.S. Cl.
CPC ..... *B65H 2801/06* (2013.01); *G03G 2215/00392* (2013.01); *G03G 2215/00725* (2013.01); *G03G 2215/00734* (2013.01)

(56) References Cited

U.S. PATENT DOCUMENTS

| | | | | |
|---|---|---|---|---|
| 6,304,342 | B1 * | 10/2001 | Komada ..... | G03G 15/6514 347/139 |
| 6,788,434 | B1 | 9/2004 | Kanematsu | |
| 8,576,427 | B2 | 11/2013 | Sakai | |
| 8,605,306 | B2 | 12/2013 | Takahashi | |
| 9,223,275 | B2 * | 12/2015 | Totsuka ..... | G03G 15/5004 |
| 2012/0162692 | A1 * | 6/2012 | Aida ..... | G03G 15/5004 358/1.14 |

* cited by examiner

IMAGE FORMING APPARATUS

BACKGROUND OF THE INVENTION

Field of the Invention

The present invention relates to an image forming apparatus configured to form an image on a fed recording material.

Description of the Related Art

Hitherto, an image forming apparatus such as a copying machine or a printer includes a sheet feeding tray in an apparatus main body so that copying or printing can be performed for a sheet continuously. Further, a size and a type of the sheet to be used greatly depend on an environment in which a user uses the image forming apparatus. To handle such a situation, the image forming apparatus is provided with a plurality of sheet feeding trays. On the other hand, even when the image forming apparatus includes a plurality of sheet feeding trays, there may arise a demand to temporarily execute the copying or printing for a sheet different from the sheet set on each of the sheet feeding trays. On the assumption that there may arise such a demand, the image forming apparatus also includes a manual feed tray besides the sheet feeding trays so that a desired sheet can be set with ease.

In order to feed and convey the sheet set on the manual feed tray and form an image in an appropriate position, the size of the sheet needs to be known, and it is necessary for the user to input the size of the sheet through an operation portion. In U.S. Pat. No. 5,689,759, there is proposed a configuration including a detecting unit configured to detect a sheet width so that a selectable sheet size is displayed on a display portion at a timing at which it is detected that the sheet is set on the manual feed tray, to thereby allow the user to select the sheet size. In such a related art, the size selected by the user is stored in a volatile memory or a non-volatile memory of a control portion. In such a configuration, there is no need to reset settings each time the copying or printing is performed until a detecting unit configured to detect presence of the sheet on the manual feed tray detects that there is no sheet on the manual feed tray.

In addition, the image forming apparatus has a power saving (sleep) mode function of stopping functions other than a part of functions for the purpose of power saving. In such an image forming apparatus, power consumption can be reduced by limiting the functions operating during a sleep mode to only a very limited part of functions such as a network interface (hereinafter referred to as "I/F"). In the related art, the presence of the sheet on the manual feed tray immediately before a shift is made to the sleep mode is compared with the presence of the sheet on the manual feed tray immediately after a recovery is made from the sleep mode. When it is determined that the sheet is set on the manual feed tray both at a timing of shifting to the sleep mode and at a timing of recovering therefrom, image forming processing is executed based on the sheet size stored in the non-volatile memory.

However, the related-art image forming apparatus has the following problem. Hitherto, when a shift is made to the sleep mode with the sheet being set on the manual feed tray, if the sheet set during the sleep mode is removed and a sheet having a different size is set, and then a recovery is made from the sleep mode, a detection result obtained by the detecting unit configured to detect the presence of the sheet on the manual feed tray is the same for both before and after the sleep mode, both results indicating the presence of the sheet. Therefore, also after recovering from the sleep mode, the image forming processing is executed based on size information on the sheet selected before shifting to the sleep mode.

For example, it is assumed that a shift is made to the sleep mode with a sheet having an A3 length (420 mm) being set, the A3-length sheet is removed during the sleep mode, and a sheet having an A4 length (210 mm) is set on the manual feed tray. In this case, even when the actual size of the sheet set on the manual feed tray is the A4 length, image formation is executed based on the size information of the A3 length selected before the A4-length sheet is set. Therefore, a toner image to be formed has a larger size than the size of the conveyed sheet, and toner within an area that is not to be transferred onto the sheet adheres to a member such as a secondary transfer roller. Then, the toner that has adhered to the member causes an image failure such as marking back, that is, the toner adheres to a back surface of the sheet conveyed in subsequent image forming processing. In contrast, when a change is made from the A4-length sheet to the A3-length sheet during the sleep mode, the size of the conveyed sheet (A3 length) is longer than the stored size of the sheet (A4 length), which may lead to a determination that a paper jam has occurred.

SUMMARY OF THE INVENTION

The present invention has been made in view of such circumstances, and an object thereof is to allow a size of a sheet changed after a recovery from sleep to be decided even when the sheet on a manual feed tray is changed during a sleep mode of an image forming apparatus, to thereby prevent an image failure and a paper jam.

According to one embodiment of the present invention, there is provided an image forming apparatus, including:

a manual feed tray on which a recording material is stacked;

a first detecting unit configured to detect presence of the recording material on the manual feed tray;

a second detecting unit configured to detect a length of the recording material on the manual feed tray in a direction perpendicular to a conveyance direction of the recording material;

a third detecting unit configured to detect a length of the recording material on the manual feed tray in the conveyance direction;

a decision unit configured to decide a size of the recording material based on detection results of the first, the second, and the third detecting unit, the image forming apparatus being operable in a first mode in which power is supplied to the decision unit and a second mode in which the power is not supplied to the decision unit;

a storage unit configured to store the size of the recording material decided by the decision unit when the image forming apparatus is shifted from the first mode to the second mode;

a display unit configured to display information; and a control unit configured to cause the display unit to display a screen for confirming the size of the recording material on the manual feed tray in a case where the size of the recording material decided by the decision unit when the image forming apparatus is shifted from the second mode to the first mode does not match the size of the recording material stored in the storage unit.

Further features of the present invention will become apparent from the following description of exemplary embodiments with reference to the attached drawings.

DESCRIPTION OF THE EMBODIMENTS

[First Embodiment]

(Image Forming Apparatus)

Figure 1:
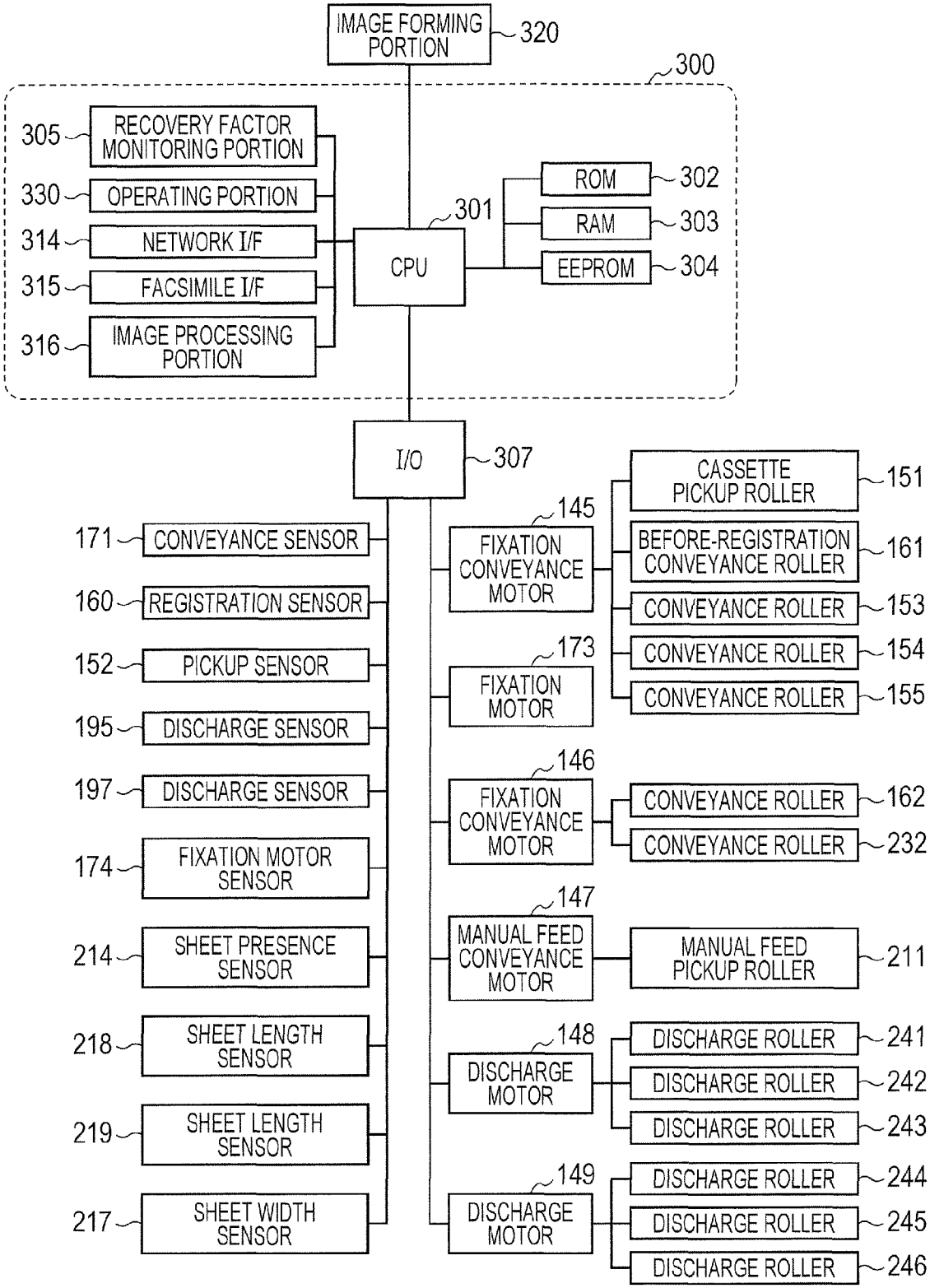
FIG. 1 is a system block diagram of an image forming apparatus according to a first embodiment and a second embodiment.
Figure 2:
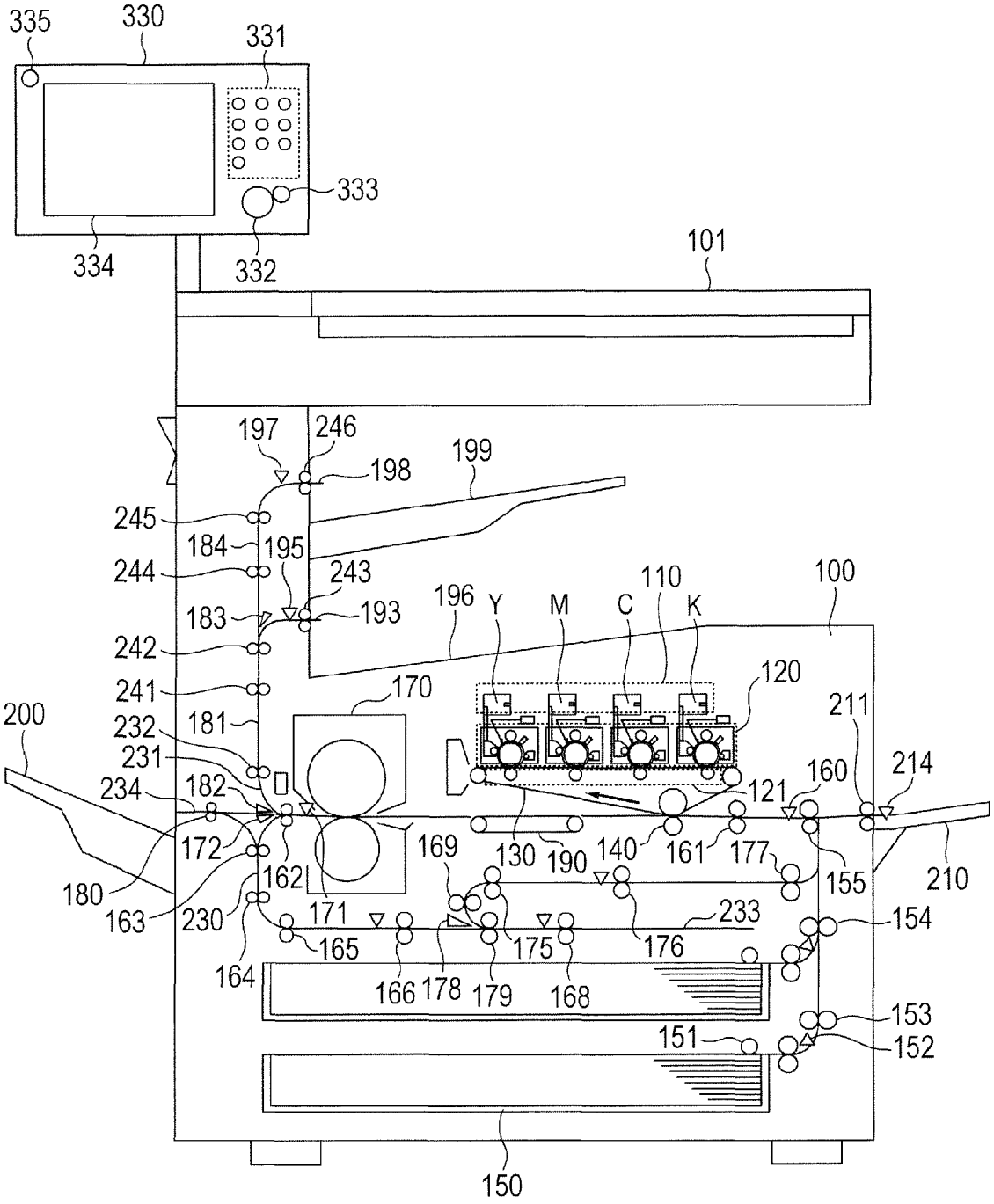
FIG. 2 is a diagram for illustrating a configuration of the image forming apparatus according to the first embodiment and the second embodiment.

FIG. 1 is a system block diagram of an image forming apparatus according to a first embodiment, and FIG. 2 is a sectional view of an image forming apparatus 100 and a scanner portion 101 according to the embodiment. With reference to FIG. 1 and FIG. 2, a basic configuration will be described. A control portion 300 illustrated in FIG. 1 includes a CPU 301, a ROM 302, a RAM 303, an EEPROM 304, and a recovery factor monitoring portion 305. Note that, the recovery factor monitoring portion 305 will be described later. When, for example, an instruction (hereinafter referred to as "job") to start a printing operation is input to the CPU 301 through a user interface (UI) of an operation portion 330 (hereinafter referred to simply as "operation portion 330"), the CPU 301 starts the printing operation. The CPU 301 can drive and control, via an I/O 307, a fixation conveyance motor 145, a fixation motor 173, a fixation conveyance motor 146, a manual feed conveyance motor 147, a discharge motor 148, and a discharge motor 149. Further, the CPU 301 can detect, via the I/O 307, input signals input from a conveyance sensor 171, a registration sensor 160, a pickup sensor 152, a discharge sensor 195, and a discharge sensor 197.

Further, the CPU 301 can detect, via the I/O 307, input signals input from a fixation motor sensor 174, a sheet presence sensor 214, a sheet length sensor 218, and a sheet length sensor 219. Here, the sheet length represents a length of a sheet in a conveyance direction of the sheet. Then, the CPU 301 can detect, via the I/O 307, an input signal input from a sheet width sensor 217. In addition, the CPU 301 can also receive jobs input from a network I/F 314 and a facsimile I/F 315. For example, the CPU 301 is connected to a network configured to communicate with an external apparatus, and receives a job from the external apparatus via the network I/F 314. Further, for example, the CPU 301 is connected to a telephone line configured to receive a facsimile, and receives a facsimile via the facsimile I/F 315.

The CPU 301 includes an image processing portion 316 configured to process an image corresponding to the job received from the operation portion 330 or the like, and executes the image processing such as rotation and expansion of the image. Further, the CPU 301 can control an image forming portion 320. The image forming portion 320 can control drive and supply of a high voltage to a process unit 120 indicated by the dotted frame in FIG. 2, a transfer belt 130, a secondary transfer portion 140, and the like, and can control a laser scanner unit 110 indicated by the dotted frame. Further, the image forming portion 320 can control a temperature of a heater of the fixing device 170 illustrated in FIG. 2. The scanner portion 101 executes an operation for reading an original when copying is executed.

Next, with reference to FIG. 1 and FIG. 2, a basic image forming operation will be described. When receiving a job from the operation portion 330, the CPU 301 analyzes the received job, and starts a printing operation. The CPU 301 drives, via the I/O 307, the fixation conveyance motor 145 serving as a drive source of a cassette pickup roller 151, to thereby rotationally drive the cassette pickup roller 151 to feed and convey sheets within a sheet feeding cassette 150 one by one. At this time, the CPU 301 uses the pickup sensor 152 to monitor whether or not a sheet feeding operation has been normally executed for the sheets.

Sheet conveyance from the manual feed tray 210 will be described. The CPU 301 operates as follows when receiving an instruction to convey a sheet on the manual feed tray 210 from the operation portion 330 with the sheets serving as recording materials being stacked on the manual feed tray 210. In other words, the CPU 301 drives the manual feed conveyance motor 147 via the I/O 307 to rotate a manual feed pickup roller 211. When rotation of the manual feed pickup roller 211 is started, the sheets on the manual feed tray 210 are fed and conveyed one by one. In the same manner as in the case of sheet feeding from the sheet feeding cassette 150, the CPU 301 monitors the registration sensor 160 to determine whether or not the sheet feeding operation has been normally executed. Further, the sheet presence sensor 214 serving as a first detecting unit is a sensor configured to determine whether or not a sheet is set on the manual feed tray 210. Note that, a configuration of the manual feed tray 210 will be described later in detail.

The CPU 301 causes the process unit 120 to start the image forming operation so as to be in time with arrival of the sheet at the secondary transfer portion 140. The process unit 120 includes a photosensitive drum, a developing device, a charging roller, and a photosensitive drum cleaner. In the process unit 120, after a surface of the photosensitive drum is charged, an electrostatic latent image is formed on the photosensitive drum by a laser beam emitted from the laser scanner unit 110. Then, the electrostatic latent image formed on the photosensitive drum is developed on the photosensitive drum by the toner within the developing device, and becomes a toner image. After that, the toner image formed on the photosensitive drum is applied with a primary transfer voltage in a primary transfer portion 121 indicated by the dotted frame, and the toner image is transferred onto the transfer belt 130. The toner image transferred onto the transfer belt 130 is conveyed to the secondary transfer portion 140 by rotation of the transfer belt 130.

Further, the CPU 301 monitors the registration sensor 160 to detect a position of the sheet conveyed by conveyance rollers 153, conveyance rollers 154, and conveyance rollers 155. Then, in consideration of a timing at which a leading edge of the sheet reaches the registration sensor 160, the CPU 301 controls the conveyance of the sheet so that the leading edge of the sheet and the leading edge of the toner image on the transfer belt 130 coincide with each other at the secondary transfer portion 140. For example, when, compared to the toner image, the sheet has reached the registration sensor 160 earlier than a defined timing, the CPU 301 stops the sheet for a predetermined time period at before-registration conveyance rollers 161 and restarts the conveyance of the sheet thereafter. In the above-mentioned manner, the CPU 301 applies a secondary transfer voltage to the secondary transfer portion 140 for the sheet and the toner image that have reached the secondary transfer portion 140, to thereby transfer the toner image onto the sheet.

The sheet having the toner image transferred thereon is conveyed to a conveyor belt 190 and a fixing device 170. In the fixing device 170, the unfixed toner image which has transferred onto the sheet is heated and fixed to the sheet. After that, the sheet is further conveyed to a downstream-side part in the conveyance direction of the sheet. When the leading edge of the sheet subjected to the fixing reaches the conveyance sensor 171, the CPU 301 executes the following operation. In other words, the CPU 301 determines, based on contents of the job designated through the operation portion 330 in advance, which conveyance path of a sheet conveyance path 230, a sheet conveyance path 231, and a sheet conveyance path 234 the sheet is to be conveyed by conveyance rollers 162. The CPU 301 switches a conveyance destination of the sheet by switching a conveyance flapper 172 and a conveyance flapper 182.

Specifically, when the job designated through the operation portion 330 is a two-side print job, and when the sheet is to be discharged to a discharge tray 200 with a printed surface thereof facing downward, the CPU 301 switches the conveyance flapper 172 in order to convey the sheet to the sheet conveyance path 230. Further, when the sheet is to be discharged onto a discharge tray 196 or a discharge tray 199 at a time of one-side printing or two-side printing, the CPU 301 conveys the sheet to the sheet conveyance path 231 by switching the conveyance flapper 182. In addition, when the job designated through the operation portion 330 is a discharge instruction with respect to the discharge tray 200, the CPU 301 conveys the sheet to the sheet conveyance path 234 by switching the conveyance flapper 172 and the conveyance flapper 182.

The sheet conveyed to the sheet conveyance path 231 is further conveyed to a downstream side in the conveyance direction of the sheet (hereinafter referred to as "downstream side") by conveyance rollers 232. Subsequently, the sheet is conveyed to a sheet conveyance path 181, and conveyed toward the discharge tray 196 and the discharge tray 199. The sheet conveyed to the sheet conveyance path 181 is conveyed by a discharge roller 241 and a discharge roller 242 driven by the discharge motor 148. When the job designated through the operation portion 330 is a discharge instruction with respect to the discharge tray 196, the CPU 301 conveys the sheet to a conveyance path 193 by switching a flapper 183, to thereby discharge the sheet onto the discharge tray 196 by a discharge roller 243. On the other hand, when the job designated through the operation portion 330 is a discharge instruction with respect to the discharge tray 199, the CPU 301 switches the flapper 183 toward a conveyance path 184. Subsequently, the CPU 301 conveys the sheet to a conveyance path 198 by a discharge roller 244, a discharge roller 245, and a discharge roller 246 that are driven by the discharge motor 149, to thereby discharge the sheet onto the discharge tray 199.

Further, when the sheet is discharged to the discharge tray 200 with the printed surface facing down at the time of performing the one-side printing, the CPU 301 conveys the sheet to the sheet conveyance path 230. Then, at a timing at which a trailing edge of the sheet passes through a reversal roller 163, the CPU 301 reverse-rotationally drives the reversal roller 163, two-side conveyance rollers 164, and the like so that the sheet is conveyed toward a discharge roller 180, to thereby discharge the sheet onto the discharge tray 200. Alternatively, in the two-side printing, the sheet is conveyed to the sheet conveyance path 230. Then, the sheet is conveyed to a two-side reversing conveyance path 233 by the two-side conveyance rollers 164 to 166, 179, and 168. Subsequently, at a timing at which the trailing edge of the sheet passes through the two-side conveyance rollers 179, the CPU 301 switches a two-side reversing flapper 178 toward two-side conveyance rollers 169, to reverse-rotationally drive the rollers such as the two-side conveyance rollers 168 and 179. Subsequently, the sheet is conveyed by the two-side conveyance rollers 169 and 175 to 177, to be passed to the conveyance rollers 155. After all the jobs are finished, the CPU 301 displays on the operation portion 330 that the jobs have been finished.

The operation portion 330 includes an input key group 331 used when a user inputs information, which is indicated by the dotted frame, and a start key 332 to be pressed when the image forming operation is started. Further, the operation portion 330 includes a stop key 333 to be pressed when the image forming operation or the like is interrupted, a display portion 334 serving as a display unit, and a sleep button 335. The sleep button 335 of the operation portion 330 is a button configured to be pressed when the image forming apparatus 100 shifts to a sleep mode or recovers from the sleep mode. The sleep mode represents a power saving status in which power consumption is reduced. Note that, the sleep mode of the image forming apparatus 100 will be described later in detail. Note that, the above-mentioned basic image forming operation is merely an example, and the present invention is not limited to the above-mentioned configuration.

(Manual Feed Tray)

Figure 3A:
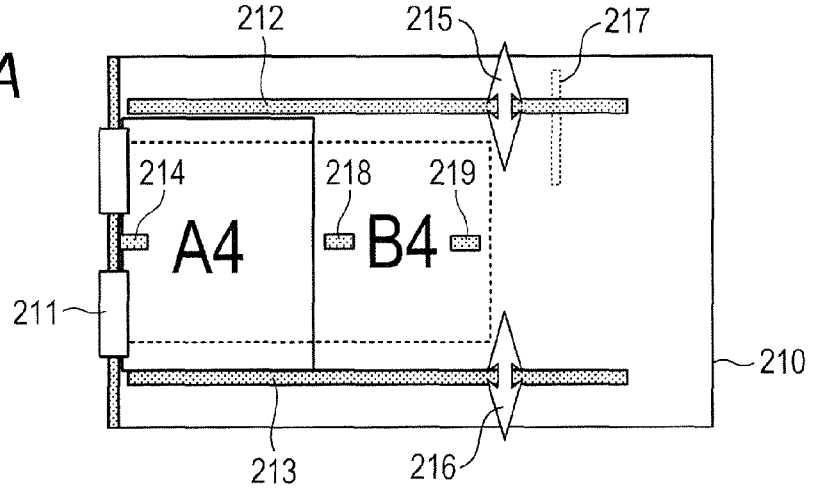
FIG. 3A is a top view of a manual feed tray according to the first embodiment and the second embodiment.

FIG. 3A is a top view of the manual feed tray 210, and a main body of the image forming apparatus 100 is located on the left side of FIG. 3A. When a sheaf of sheets (hereinafter sometimes referred to simply as "sheet") is set on the manual feed tray 210, the sheets are separated from the sheaf of sheets one by one by the manual feed pickup roller 211, to be conveyed. When the sheets are set on the manual feed tray 210, the sheet presence sensor 214 is turned on, an ON signal is input from the sheet presence sensor 214 to the CPU 301, and the CPU 301 determines that the manual feed tray 210 indicates sheet presence. Further, the sheaf of sheets set on the manual feed tray 210 is sandwiched at both end portions of the sheaf of sheets by side-regulating guides 212 and 213 serving as regulating plates. This prevents the sheet from being skew fed and conveyed while the sheet is conveyed by the manual feed pickup roller 211. Further, by causing the side-regulating guides 212 and 213 to slide in directions indicated by arrows 215 and 216 in FIG. 3A, it is possible to prevent the sheet from being skew fed even when the sheet having a different sheet width is set. Here, the sheet width represents the length of the sheet in a direction perpendicular to the conveyance direction. In addition, the side-regulating guides 212 and 213 are coupled to each other through the sheet width sensor 217 serving as a second detecting unit and a link member (not shown). Therefore, the sheet width sensor 217 outputs a signal (AD value) corresponding to positions of the side-regulating guides 212 and 213 to the CPU 301 in linkage with operations of the side-regulating guides 212 and 213.

The CPU 301 detects the sheet width based on the signal (AD value) input from the sheet width sensor 217. Further, the sheet length sensors 218 and 219 serving as a third detecting unit have, for example, a flag type configuration, and detect the length of the sheet set on the manual feed tray 210. Here, the sheet length represents the length of the sheet in the conveyance direction.

(Sheet Size Detection)

Figure 3B:
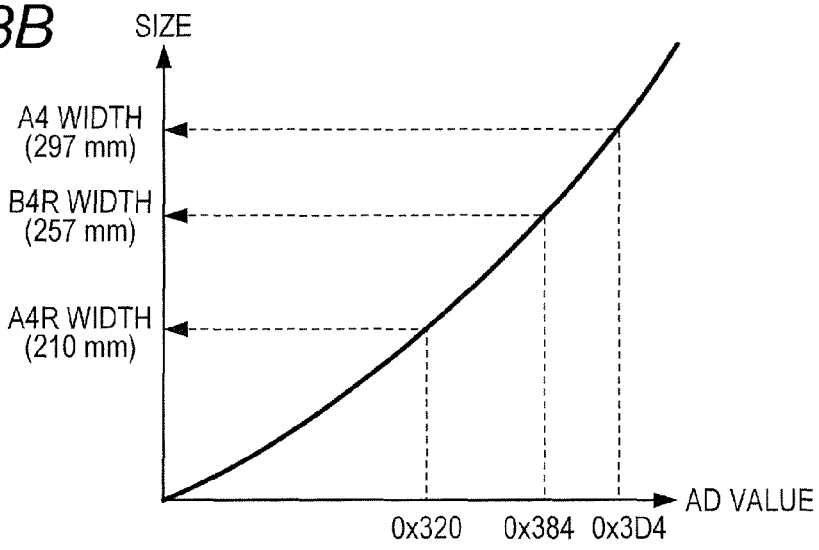
FIG. 3B is a graph for showing a relationship between an AD value and a sheet size.

With reference to FIG. 3B and Table 1, a method of detecting a size of the sheet set on the manual feed tray 210 will be described. FIG. 3B is a graph for showing a relationship between the signal (AD value) output from the sheet width sensor 217 based on the positions of the side-regulating guides 212 and 213 and the sheet width, namely paper width, to be detected in actuality. Specifically, in FIG. 3B, the horizontal axis indicates the AD value (such as 0x3D4) output by the sheet width sensor 217, while the vertical axis indicates the size of the sheet (sheet width) (such as A4 width (297 mm)). The sheet width sensor 217 is a sensor configured to output, specifically, a 10-bit digital value and to output, substantially linearly, output values 0x000 to 0x400 in the hexadecimal format.

As shown in FIG. 3B, the output value 0x320 of the sheet width sensor 217 represents 210 mm indicating the A4R width, the output value 0x384 similarly represents 257 mm indicating the B4R width, and the output value 0x3D4 represents 297 mm indicating the A4 width. In other words, for example, when the AD value 0x320 is input from the sheet width sensor 217, the CPU 301 determines that the sheet width of the sheet set on the manual feed tray 210 is 210 mm. The CPU 301 detects the sheet width of the sheet from the output value (AD value) of the sheet width sensor 217, and detects the sheet length from the output values of the sheet length sensors 218 and 219. Then, the CPU 301 refers to Table 1 to determine the size of the sheet from those detection results.

TABLE 1

| Size | Sheet width | Sheet length | Sheet presence sensor 214 | Sheet length sensor 218 | Sheet length sensor 219 | Sheet width sensor 217 |
|---|---|---|---|---|---|---|
| A5 | 210 | 148 | ON | OFF | OFF | 0 × 320 ± 0 × 10 |
| B5 | 257 | 182 | ON | OFF | OFF | 0 × 384 ± 0 × 10 |
| A4 | 297 | 210 | ON | OFF | OFF | 0 × 3D4 ± 0 × 10 |
| A5R | 148 | 210 | ON | OFF | OFF | 0 × 258 ± 0 × 10 |
| B5R | 182 | 257 | ON | ON | OFF | 0 × 2E4 ± 0 × 10 |
| A4R | 210 | 297 | ON | ON | OFF | 0 × 320 ± 0 × 10 |
| B4 | 257 | 364 | ON | ON | ON | 0 × 384 ± 0 × 10 |
| A3 | 297 | 420 | ON | ON | ON | 0 × 3D4 ± 0 × 10 |

Table 1, in which the size of the sheet, the sheet width (mm), and the sheet length (mm) are shown from the left, is information obtained by associating the detection results obtained by the respective sensors with the sizes of the sheet. In addition, in Table 1, the detection result from the sheet presence sensor 214, the detection results from the sheet length sensors 218 and 219, and the detection result from the sheet width sensor 217 are shown. Note that, as described above, the sheet width sensor 217 outputs the AD value to the CPU 301, and the other sensors output a signal of ON or OFF to the CPU 301.

The CPU 301 refers to those detection results from the sensors and Table 1, to thereby determine and decide the size of the sheet. In other words, the CPU 301 functions as a decision unit configured to decide the size of the sheet. For example, it is assumed that the sheet presence sensor 214 outputs the ON signal, the sheet length sensor 218 outputs the OFF signal, the sheet length sensor 219 outputs the OFF signal, and the sheet width sensor 217 outputs the AD value 0x320±0x10. In this case, the CPU 301 determines that the sheet set on the manual feed tray 210 is an A5-size sheet based on the detection results from the respective sensors and the information on Table 1. In the same manner, it is assumed that the sheet presence sensor 214 outputs the ON signal, the sheet length sensor 218 outputs the ON signal, the sheet length sensor 219 outputs the OFF signal, and the sheet width sensor 217 outputs the AD value 0x320±0x10. In this case, the CPU 301 determines that the sheet set on the manual feed tray 210 is an A4R-size sheet to be fed by a short edge feed of A4. The short edge feed of A4 represents the feeding of the sheet with the shorter side of an A4-size sheet being located perpendicularly to the conveyance direction.

Further, as shown in Table 1, even when the output value of the sheet width sensor 217 is the same, it is possible to determine that the size is different based on a difference in the detection results from the sheet length sensors 218 and 219. For example, even when the output value of the sheet width sensor 217 is the same AD value 0x320±0x10, the size of the sheet can be distinguished between A5 and A4R based on the detection results from the sheet length sensors 218 and 219.

In contrast, even when the detection results from the sheet length sensors 218 and 219 are the same, it is possible to determine that the size is different based on the difference in the output value of the sheet width sensor 217. For example, even when the detection results from the sheet length sensors 218 and 219 are OFF, it can be determined as follows based on the AD value of the sheet width sensor 217. For example, the size of the sheet can be determined as A5, B5, A4, and A5R when the AD value of the sheet width sensor 217 is 0x320±0x10, 0x384±0x10, 0x3D4±0x10, and 0x258±0x10, respectively.

(Information Screen of Manual Feed Sheet Size)

Figure 3C:
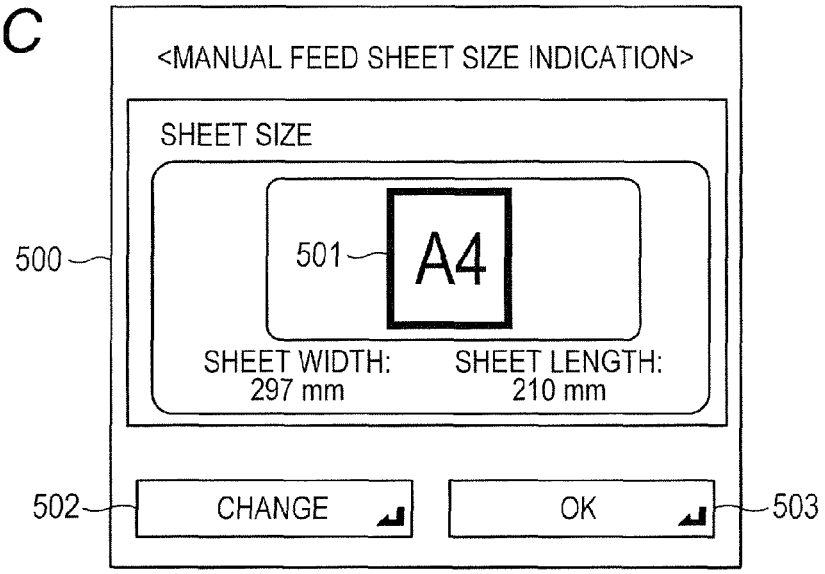
FIG. 3C is a diagram for illustrating a manual feed sheet size indication screen.

With reference to FIG. 3C, a screen displayed on the display portion 334 of the operation portion 330 in order to prompt the user to confirm the size of the sheet set on the manual feed tray 210 will be described. FIG. 3C is a diagram for illustrating an information screen 500 of a manual feed sheet size (hereinafter referred to simply as "information screen 500") displayed on the display portion 334 of the operation portion 330. Specifically, the information screen 500 is a screen configured to display the size of the sheet set on the manual feed tray 210, which is determined by the CPU 301, in order to prompt the user to confirm the size. Note that, the method of detecting the size of the sheet set on the manual feed tray 210 will be described later with reference to FIG. 4. Here, when the size of the sheet that the user wishes to use matches a displayed size 501 displayed on the information screen 500, an OK button 503 is pressed. On the other hand, when the size of the sheet set on the manual feed tray 210 is different from the displayed size 501 displayed on the information screen 500, a change button 502 is pressed. Note that, information on the sheet size displayed in the displayed size 501 of the information screen 500 will be described later.

(Displaying Processing for Information Screen of Manual Feed Sheet Size)

Figure 4:
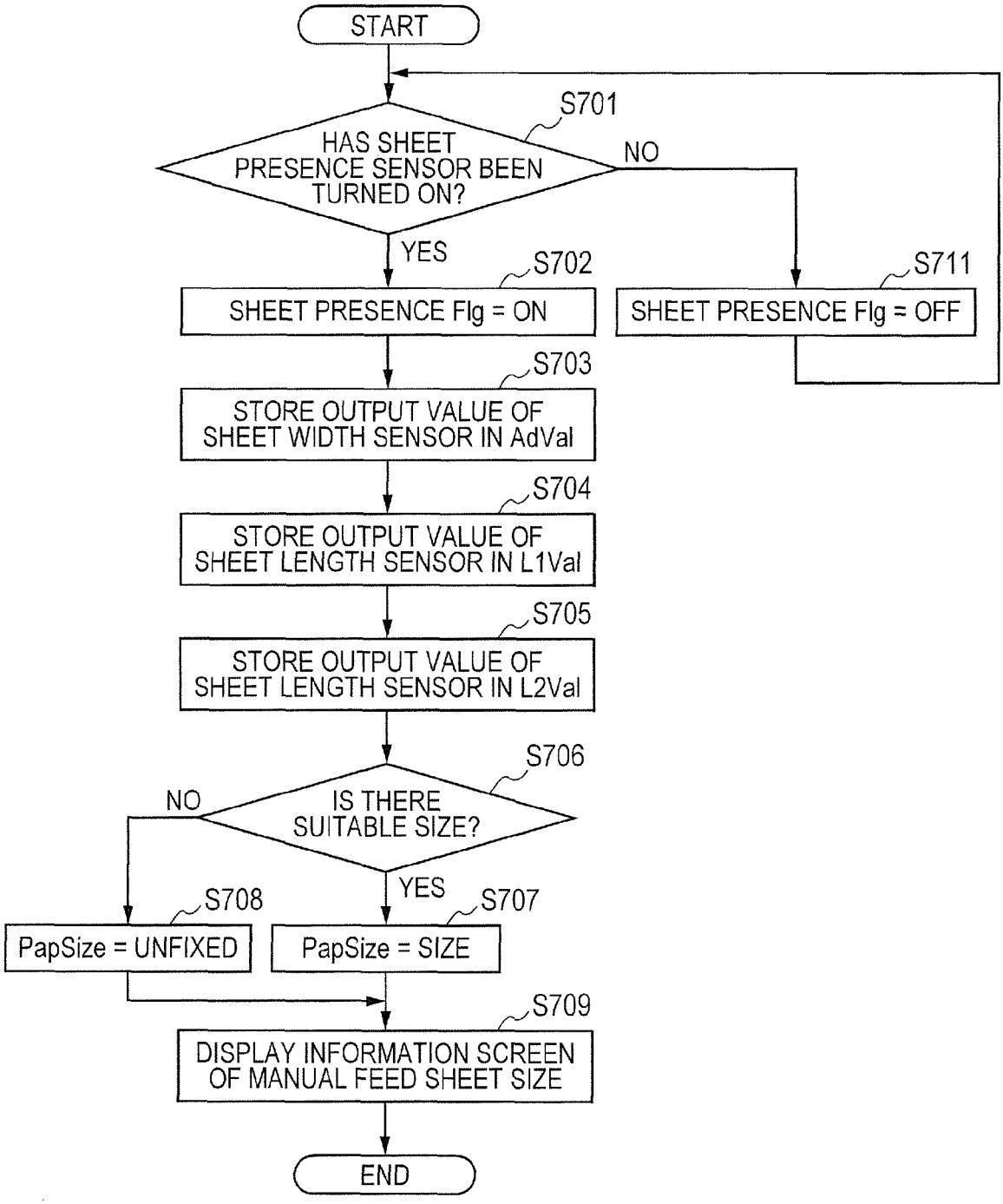
FIG. 4 is a flowchart for displaying an information screen of a manual feed sheet size according to the first embodiment.

FIG. 4 is a flowchart for illustrating processing performed when the image forming apparatus 100 is operating in a normal mode with power being supplied to the CPU 301 after a sheet is set on the manual feed tray 210 until the information screen 500 is displayed on the display portion 334 of the operation portion 330. Note that, the normal mode will be described later. The CPU 301 starts processing in accordance with a control program stored in the ROM 302. In S701, the CPU 301 determines whether or not the sheet presence sensor 214 has been turned on. It is assumed that the CPU 301 constantly monitors the output (ON or OFF) from the sheet presence sensor 214 while the image forming apparatus 100 is operating in the normal mode.

When determining in S701 that the sheet presence sensor 214 is in an off state, the CPU 301 sets the sheet presence flag (hereinafter referred to as "SheetPresenceFlg") to OFF (SheetPresenceFlg=OFF) in S711, and returns to the processing of S701. Here, SheetPresenceFlg is a variable for storing a value stored in the RAM 303, and a variable referred to by the CPU 301 in order to determine whether or not the sheet is set on the manual feed tray 210.

When determining in S701 that the sheet presence sensor 214 has been turned on, the CPU 301 advances to the processing of S702. In S702, the CPU 301 stores ON in SheetPresenceFlg (SheetPresenceFlg=ON). In S703, the CPU 301 stores the output value of the sheet width sensor 217 in AdVal. Here, AdVal is a variable for storing a value stored in the RAM 303. In S704, the CPU 301 stores the output value of the sheet length sensor 218 in L1Val. In S705, the CPU 301 stores the output value of the sheet length sensor 219 in L2Val. Here, L1Val and L2Val are each a variable for storing a value stored in the RAM 303. In the following description, the variable for storing the value stored in the RAM 303 is referred to simply as "variable of the RAM 303".

In S706, the CPU 301 compares the values stored in the variables of the RAM 303 in the processing of S702 to S705 with Table 1 to determine whether or not Table 1 includes a suitable size. When determining in S706 that Table 1 includes a suitable size, in S707, the CPU 301 stores information (such as A5) on the suitable size in PapSize serving as the variable of the RAM 303 (PapSize=size). On the other hand, when determining in S706 that Table 1 does not include the suitable size, in S708, the CPU 301 stores information (for example, "unfixed") indicating that the size is unfixed in PapSize (PapSize=unfixed).

In S709, based on the information on the size of the sheet stored in PapSize in S707 or S708, the CPU 301 displays the information screen 500 on the display portion 334 of the operation portion 330, and brings the processing to an end. In other words, based on the information on the size of the sheet stored in PapSize in S707 or S708, the displayed size 501 is displayed on the information screen 500 as described with reference to FIG. 3C.

(Normal Mode and Sleep Mode)

Next, with reference to Table 2 and FIG. 5, the normal mode of the image forming apparatus 100 and the sleep mode (power-saving mode) of the image forming apparatus 100 in which the power consumption is smaller than the normal mode will be described. Table 2 is a table for describing main blocks to which the power is supplied in the normal mode and the sleep mode within the block diagram illustrated in FIG. 1. In Table 2, "o" indicates that the power is supplied, while "x" indicates that the power is not supplied. As shown in Table 2, in the normal mode serving as a first mode, the power is supplied to all the blocks except the recovery factor monitoring portion 305. On the other hand, in the sleep mode serving as a second mode, the power is supplied to the recovery factor monitoring portion 305, the operation portion 330, the network I/F 314, and the facsimile I/F 315, while the power is not supplied to the other blocks. In other words, in the sleep mode, the power is not supplied to the CPU 301, and hence the CPU 301 is not ready to perform the processing for determining the size of the sheet set on the manual feed tray 210, which is described with reference to FIG. 4.

TABLE 2

| | With or without power supply | |
|---|---|---|
| | Normal mode | Sleep mode |
| CPU | o | x |
| ROM | o | x |
| RAM | o | x |
| EEPROM | o | x |
| Operation portion | o | o |
| Network I/F | o | o |
| Facsimile I/F | o | o |
| Image processing portion | o | x |
| Image forming portion | o | x |
| Recovery factor monitoring portion | x | o |
| I/O | o | x |

Further, in the sleep mode, the power is supplied to the operation portion 330, but the operation portion 330 only needs power that allows an input to be received through the sleep button 335 in order to cancel the sleep mode, and is therefore configured to turn off a liquid crystal portion of the display portion 334. On the other hand, even during the sleep mode, the network I/F 314 and the facsimile I/F 315 need to respond to a request for image formation input to the image forming apparatus 100 through the network or through the telephone line. Therefore, the power needs to be kept supplied to the network I/F 314 and the facsimile I/F 315. The recovery factor monitoring portion 305 serving as a monitor unit monitors whether or not the sleep button 335 has been pressed and whether or not a request for image formation has been input through the network I/F 314 or the facsimile I/F 315 during the sleep mode. In other words, the fact that the sleep button 335 of the operation portion 330 has been pressed and the fact that a request for the image formation has been input through the network I/F 314 or the facsimile I/F 315 are factors that cause a shift from the sleep mode to the normal mode, and are referred to as "recovery factors".

Here, the recovery factor monitoring portion 305 comprises a circuit lower in power consumption than the CPU 301, for example, ASIC or CPLD. Here, ASIC stands for "application specific integrated circuit", and CPLD stands for "complex programmable logic device". The recovery factor monitoring portion 305 has a function of detecting that the recovery factor which causes a shift from the sleep mode to the normal mode has occurred during the sleep mode, and starting the power supply to the CPU 301. In this manner, the embodiment realizes the sleep mode in which the power consumption is reduced by supplying the power only to minimum necessary blocks of the image forming apparatus 100.

(Shift to Sleep Mode)

Figure 5:
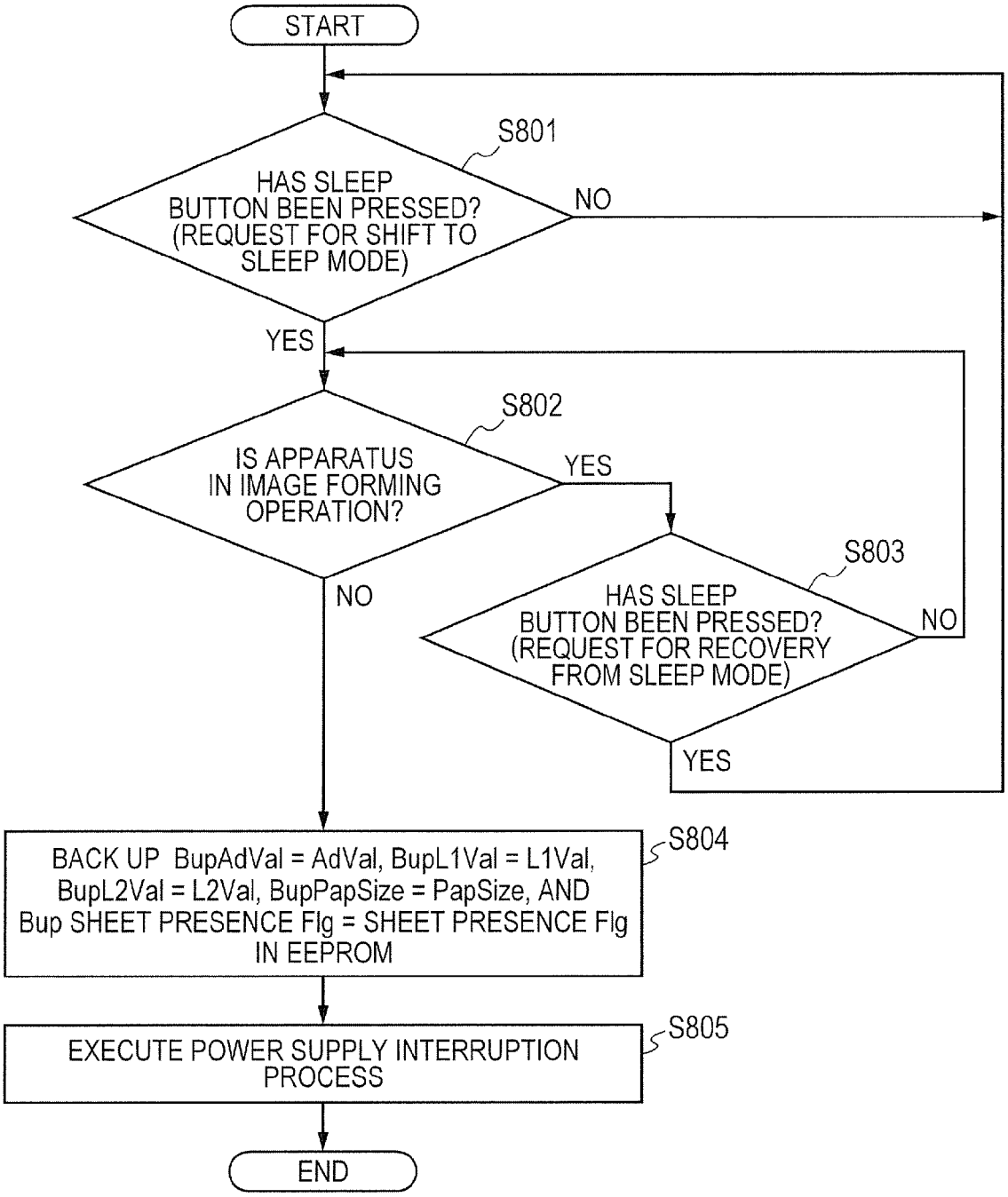
FIG. 5 is a flowchart for illustrating processing for shifting to a sleep mode according to the first embodiment.

FIG. 5 is a flowchart for illustrating processing for causing the image forming apparatus 100 to shift from the normal mode to the sleep mode. In S801, the CPU 301 determines whether or not the sleep button 335 of the operation portion 330 has been pressed. The fact that the sleep button 335 has been pressed when the image forming apparatus 100 is operating in the normal mode represents that the image forming apparatus 100 is requested to shift to the sleep mode as indicated by "request for shift to sleep mode" in FIG. 5. When determining in S801 that the sleep button 335 has not been pressed, the CPU 301 repeats the processing of S801. On the other hand, when determining in S801 that the sleep button 335 has been pressed, the CPU 301 advances to the processing of S802.

In S802, the CPU 301 determines whether or not the image forming apparatus 100 is in the image forming operation, and when determining that the image forming apparatus 100 is the image forming operation, advances to the processing of S803. In S803, the CPU 301 determines whether or not the sleep button 335 has been pressed. When determining in S803 that the sleep button 335 has been pressed, the CPU 301 determines that the recovery from the sleep mode to the normal mode has been requested as indicated by "request for recovery from sleep mode" in FIG. 5, and returns to the processing of S801. On the other hand, when determining in S803 that the sleep button 335 has not been pressed, the CPU 301 returns to the processing of S802 in order to continue the state shifted to the sleep mode, which has been requested in S801. Even in a case where, by the above-mentioned processing, the sleep button 335 has been pressed to request for the shift to the sleep mode when the image forming apparatus 100 is executing the image forming operation, it is possible to cancel the sleep mode by the processing of S803.

When determining in S802 that the image forming apparatus 100 is not in the image forming operation, the CPU 301 advances to the processing of S804. In S804, the CPU 301 stores the values of the corresponding variables of the RAM 303 in the variables BupAdVal, BupL1Val, BupL2Val, BupPapSize, and BupSheetPresenceFlg of the EEPROM 304 serving as a storage unit. In this manner, the CPU 301 backs up the information on the RAM 303 in the EEPROM 304, and advances to the processing of S805.

Here, the variable of the EEPROM 304 represents a variable for storing a value stored in the EEPROM 304. Further, the corresponding variables of the RAM 303 are, specifically, SheetPresenceFlg acquired in S702 of FIG. 4, AdVal acquired in S703, L1Val acquired in S704, L2Val acquired in S705, and PapSize determined in S707 or S708. Further, the value of AdVal, the value of L1Val, the value of L2Val of the RAM 303 are backed up in BupAdVal, BupL1Val, and BupL2Val, respectively, of the EEPROM 304. In addition, the value of PapSize and the value of SheetPresenceFlg of the RAM 303 are backed up in BupPapSize and BupSheetPresenceFlg of the EEPROM 304.

In S805, in order to shift to the sleep mode, the CPU 301 interrupts the power supply to a predetermined block based on the information relating to the power supply to the respective blocks shown in Table 2, and brings the processing to an end. Specifically, the power supply to the respective blocks except the operation portion 330, the network I/F 314, the facsimile I/F 315, and the recovery factor monitoring portion 305 is interrupted. In this manner, the CPU 301 starts the power supply to the recovery factor monitoring portion 305, and stops supplying power to the CPU 301 itself. With this operation, after the shift is made to the sleep mode, the power supply to the CPU 301 is interrupted, and the CPU 301 becomes unable to determine the size of the sheet on the manual feed tray 210.

(Recovery from Sleep Mode)

Figure 6:
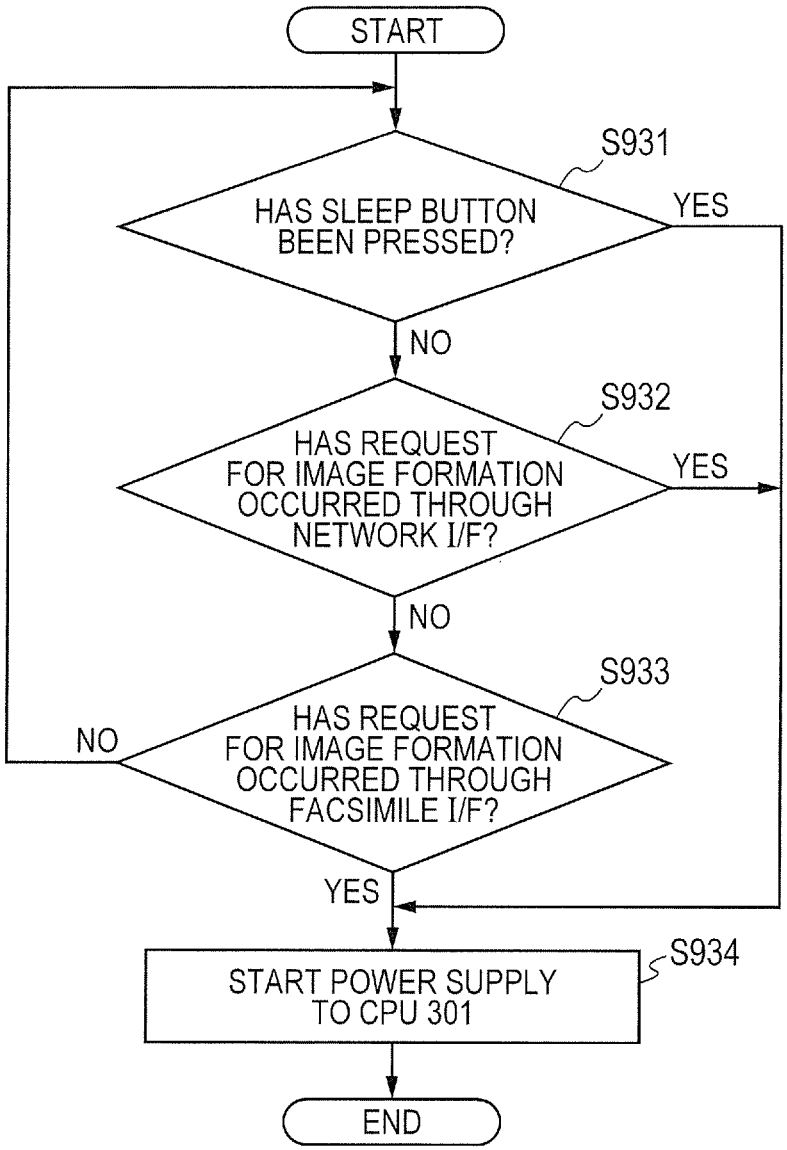
FIG. 6 is a flowchart for illustrating processing for recovering from the sleep mode according to the first embodiment and the second embodiment.

Next, a flowchart of the recovery from the sleep mode, which constitutes characteristic control of the embodiment, will be described with reference to FIG. 6. FIG. 6 is a flowchart for illustrating an operation of the recovery factor monitoring portion 305. In S931, the recovery factor monitoring portion 305 determines whether or not the sleep button 335 of the operation portion 330 has been pressed. When determining in S931 that the sleep button 335 has been pressed, the recovery factor monitoring portion 305 advances to the processing of S934, and when determining that the sleep button 335 has not been pressed, advances to the processing of S932.

In S932, the recovery factor monitoring portion 305 determines whether or not a request for image formation via the network has occurred through the network I/F 314. When determining that the request has occurred, the recovery factor monitoring portion 305 advances to the processing of S934, and when determining that the request has not occurred, advances to the processing of S933. In S933, the recovery factor monitoring portion 305 determines whether or not a request for image formation via the facsimile has occurred through the facsimile I/F 315. When determining that the request has occurred, the recovery factor monitoring portion 305 advances to the processing of S934, and when determining that the request has not occurred, returns to the processing of S931. The case where the recovery factor monitoring portion 305 advances to the processing of S934 after the determination of S931 to S933 is a case where the recovery factor monitoring portion 305 determines that the request for recovery from the sleep mode has occurred. Therefore, in S934, the recovery factor monitoring portion 305 starts the power supply to the CPU 301, and brings the processing to an end.

(Processing of CPU 301 after Recovering from Sleep Mode)

Figure 7:
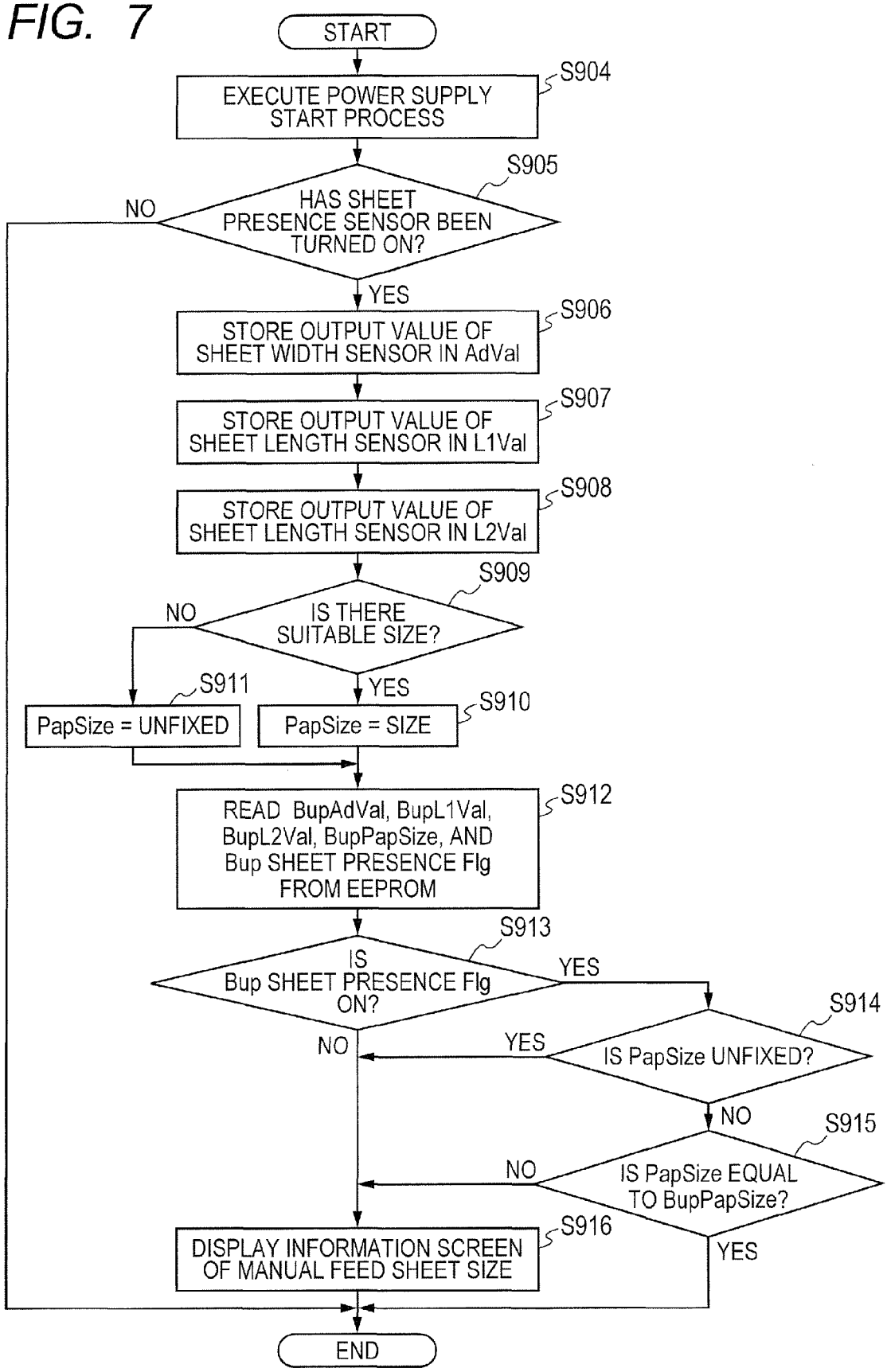
FIG. 7 is a flowchart for illustrating processing performed after recovering from the sleep mode according to the first embodiment.

FIG. 7 is a flowchart for illustrating an operation of the CPU 301 executed after the recovery factor monitoring portion 305 starts the power supply to the CPU 301 in S934 of FIG. 6 and the CPU 301 is started. In S904, the CPU 301 starts the power supply to the respective blocks based on Table 2. Note that, as shown in Table 2, the CPU 301 stops the power supply to the recovery factor monitoring portion 305. In S905, the CPU 301 determines whether or not the sheet presence sensor 214 has been turned on. When determining in S905 that the sheet presence sensor 214 is in an off state, the CPU 301 brings the processing to an end.

On the other hand, when determining in S905 that the sheet presence sensor 214 has been turned on, the CPU 301 advances to the processing of S906. In S906, the CPU 301 stores the output value of the sheet width sensor 217 in the variable AdVal of the RAM 303. In S907, the CPU 301 stores the output value of the sheet length sensor 218 in the variable L1Val of the RAM 303. In S908, the CPU 301 stores the output value of the sheet length sensor 219 in the variable L2Val of the RAM 303. In S909, the CPU 301 compares the information acquired in S905 to S908 with Table 1 to determine whether or not Table 1 includes a suitable size.

When determining in S909 that Table 1 includes the size suitable for the acquired information, in S910, the CPU 301 stores the information on the suitable size of the sheet in the variable PapSize of the RAM 303. On the other hand, when determining in S909 that Table 1 does not include the size suitable for the acquired information, in S911, the CPU 301 stores, in PapSize, information indicating that the size is unfixed. In S912, the CPU 301 reads the following information from the variables of the EEPROM 304 backed up before shifting to the sleep mode. In other words, the CPU 301 reads the values stored in BupAdVal, BupL1Val, BupL2Val, BupPapSize, and BupSheetPresenceFlg from the EEPROM 304.

In S913, the CPU 301 determines whether or not the read value of BupSheetPresenceFlg is ON. In other words, the CPU 301 determines whether or not the sheet presence sensor 214 was turned on when the shift was made to the sleep mode. When determining in S913 that the information of OFF is stored in BupSheetPresenceFlg, the CPU 301 determines that the sheet was not set on the manual feed tray 210 when the shift was made to the sleep mode, and advances to the processing of S916. In other words, this situation indicates a situation in which the sheet was not set on the manual feed tray 210 when the shift was made to the sleep mode but the sheet is set on the manual feed tray 210 when the recovery is made from the sleep mode (YES in S905). In S916, the CPU 301 displays the information screen 500 on the display portion 334 of the operation portion 330.

On the other hand, when determining in S913 that the information of ON is stored in BupSheetPresenceFlg, the CPU 301 determines that the sheet was set on the manual feed tray 210 when the shift was made to the sleep mode, and advances to the processing of S914. In S914, the CPU 301 determines whether or not PapSize storing the information on the size of the sheet on the manual feed tray 210 obtained when the recovery is made from the sleep mode, which is determined in S909, is "unfixed". When determining in S914 that PapSize is "unfixed", the CPU 301 advances to the processing of S916. When determining in S914 that PapSize is not "unfixed", the CPU 301 advances to the processing of S915.

In S915, the CPU 301 compares PapSize representing the information on the sheet size obtained when the recovery is made from the sleep mode, which is determined in S909, with BupPapSize representing the information on the sheet size obtained when the shift is made to the sleep mode. In other words, the CPU 301 determines whether or not PapSize is equal to BupPapSize. Therefore, the CPU 301 functions as a control unit configured to determine whether or not PapSize matches BupPapSize. When determining in S915 that PapSize is not equal to BupPapSize, in other words, when determining that the size of the sheet set on the manual feed tray 210 is different between at the time of shifting to the sleep mode and after the time of recovering therefrom, the CPU 301 advances to the processing of S916. In this case, the CPU 301 determines that the sheet on the manual feed tray 210 has been replaced by another sheet having a different size during the sleep mode.

When determining in S915 that PapSize is equal to BupPapSize, in other words, when determining that the size of the sheet set on the manual feed tray 210 is the same between the time of shifting to the sleep mode and the time of recovering therefrom, the CPU 301 brings the processing to an end. In other words, when the sheet presence sensor 214 detects the sheet presence both at the time of shifting to the sleep mode and after the time of recovering therefrom and when the size of the sheet determined based on the detection results from the respective sensors matches therebetween, the CPU 301 brings the processing to an end without displaying the information screen 500 of the manual feed sheet size on the display portion 334 of the operation portion 330.

According to the embodiment described above, even when a sheet on a manual feed tray is changed during the sleep mode of the image forming apparatus, it is possible to decide the size of the sheet changed after a recovery from sleep, to thereby prevent an image failure or a paper jam.

[Second Embodiment]

Next, a second embodiment will be described with reference to FIG. 8 to FIG. 10. Note that, an operation of the recovery factor monitoring portion 305 during the sleep mode is the same as the operation described in the first embodiment with reference to FIG. 6, and hence FIG. 6 is referred to here as well. The first embodiment is configured to display the information screen 500 for prompting the user to confirm the size of the sheet on the manual feed tray 210 when the normal mode is recovered from the sleep mode in the case where the sheet on the manual feed tray 210 is changed or in other such cases (S916 in FIG. 7). The embodiment is configured to display the information screen 500 at a timing at which the manual feed tray 210 is selected when image forming processing is performed, instead of displaying the information screen 500 on the display portion 334 of the operation portion 330 after the recovery is made from the sleep mode.

(Recovery from Sleep Mode)

Figure 8:
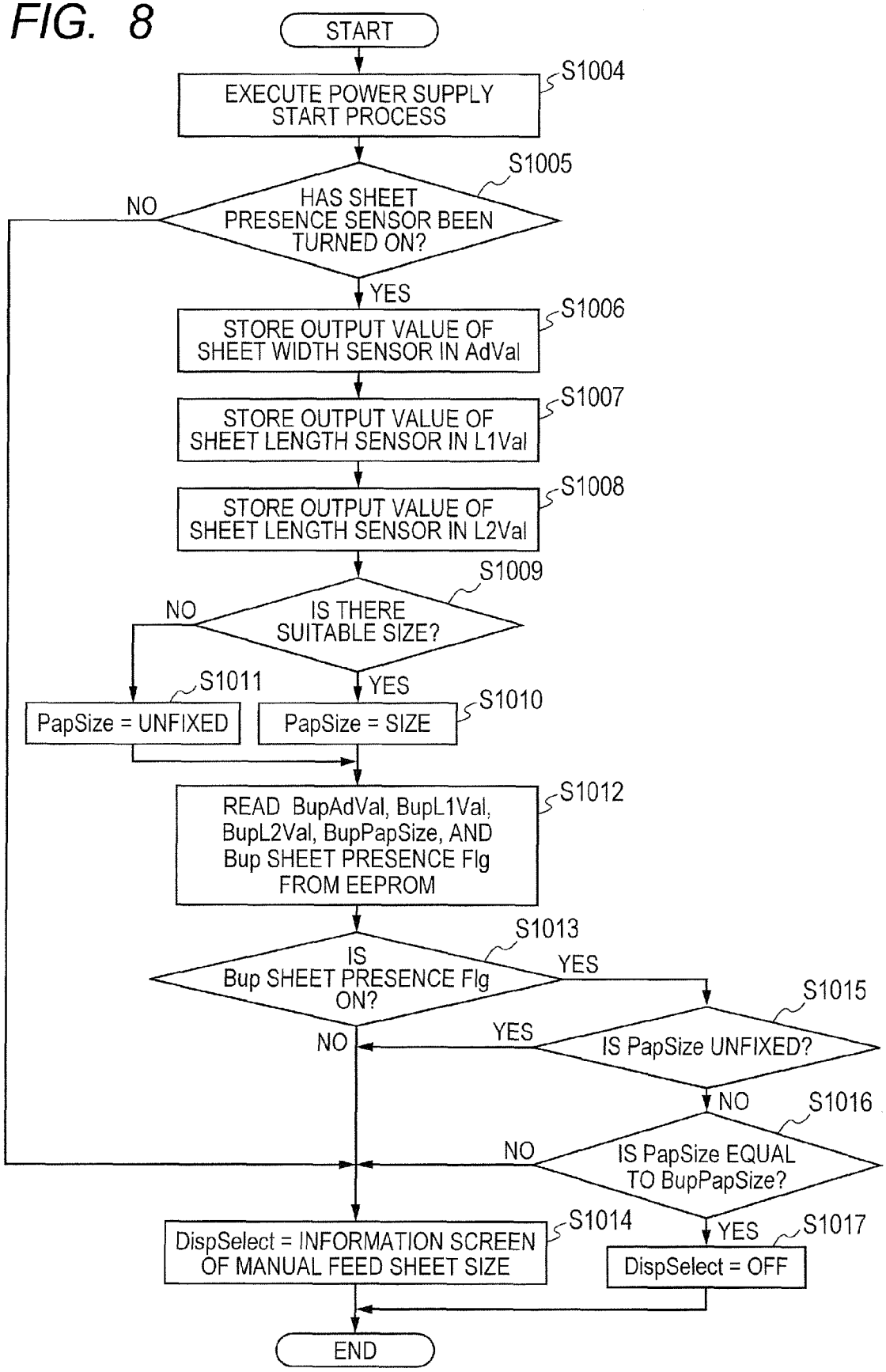
FIG. 8 is a flowchart for illustrating processing performed after recovering from the sleep mode according to the second embodiment.

FIG. 6 and FIG. 8 are flowcharts for illustrating processing for recovering from the sleep mode according to the embodiment. The processing illustrated in FIG. 6 has been described in the first embodiment, and hence the description thereof is omitted.

(Processing of CPU 301 after Recovering from Sleep Mode)

FIG. 8 is a flowchart for illustrating an operation of the CPU 301 executed after the recovery factor monitoring portion 305 starts the power supply to the CPU 301 in S934 of FIG. 6 and the CPU 301 is started. Note that, the processing of S1004 to S1013, S1015, and S1016 is the same as the processing of S904 to S915 illustrated in FIG. 7, and hence the description thereof is omitted. However, when determining in S1005 that the sheet presence sensor 214 is in an off state, the CPU 301 advances to the processing of S1014. Further, when determining in S1013 that BupSheetPresenceFlg stores OFF, the CPU 301 advances to the processing of S1014. In addition, the CPU 301 advances to the processing of S1014 when determining in S1015 that PapSize stores the information indicating "unfixed" or when determining in S1016 that PapSize is not equal to BupPapSize.

In S1014, the CPU 301 stores, in a variable DispSelect in the RAM 303, information indicating that the information screen 500 is to be displayed on the display portion 334 of the operation portion 330 (for example, "information screen of the manual feed sheet size"). In other words, a case where the information indicating that the information screen 500 is to be displayed is stored in DispSelect when the CPU 301 refers to DispSelect means that the sheet on the manual feed tray 210 may have been changed during the sleep mode. Here, DispSelect is a variable used to determine whether or not to display the information screen 500 on the display portion 334 of the operation portion 330 in FIG. 9 and FIG. 10 described later.

When determining in S1016 that PapSize is equal to BupPapSize, the CPU 301 advances to the processing of S1017. In S1017, the CPU 301 stores OFF in DispSelect. In other words, a case where OFF is stored in DispSelect means that the sheet on the manual feed tray 210 has not been changed during the sleep mode. With this configuration, when the sheet presence sensor 214 detects the sheet presence both at the time of shifting to the sleep mode and at the time of recovering therefrom and when the size of the sheet determined based on the detection results from the respective sensors matches the size of the sheet obtained when the shift is made to the sleep mode, the CPU 301 inhibits the information screen 500 from being displayed on the display portion 334. In the first embodiment, when the sheet on the manual feed tray 210 has been changed after the recovery is made from the sleep mode, the CPU 301 displays the information screen 500 on the display portion 334 of the operation portion 330 in S916 of FIG. 7. However, in the embodiment, in the processing after the recovery is made from the sleep mode, the CPU 301 inhibits the information screen 500 from being displayed on the display portion 334. In the embodiment, in the processing after the recovery is made from the sleep mode, the CPU 301 holds the information (DispSelect) indicating the presence of the display on the display portion 334, which is decided based on the information relating to the sheet on the manual feed tray 210.

(Timing to Set DispSelect)

A timing to clear the value of DispSelect set in S1014 or S1017 of FIG. 8 will be described. The flowchart illustrated in FIG. 9 is executed when the image forming apparatus 100 is operating in the normal mode. Note that, the processing of S1101 to S1108, S1110, and S1113 of FIG. 9 is the same as the processing of S701 to S709 and S711 of FIG. 4, and hence the description thereof is omitted.

After the value is stored in the variable PapSize of the RAM 303 in S1107 or S1108, in S1109, the CPU 301 determines whether or not the value stored in the variable DispSelect of the RAM 303 is OFF. When determining in S1109 that DispSelect is OFF, the CPU 301 determines that the sheet having the same size as before the shift is made to the sleep mode is set on the manual feed tray still after the recovery is made from the sleep mode, and brings the processing to an end.

On the other hand, when determining in S1109 that DispSelect is not OFF, in S1110, the CPU 301 displays the information screen 500 on the display portion 334 of the operation portion 330. In other words, the sheet set on the manual feed tray 210 may have been changed during the sleep mode, and hence the CPU 301 displays the screen for prompting the user to confirm the size of the sheet set on the manual feed tray 210. In S1111, the CPU 301 stores OFF in the variable DispSelect of the RAM 303, and brings the processing to an end.

Further, the CPU 301 determines in S1101 that the sheet presence sensor 214 is in an off state, and advances to the processing of S1114 after executing in the processing of S1113. In S1114, the CPU 301 stores, in DispSelect, the information indicating that the information screen 500 is to be displayed on the display portion 334 of the operation portion 330, and returns to the processing of S1101.

(Timing to Display Information Screen of Manual Feed Tray Sheet Size)

Figure 9:
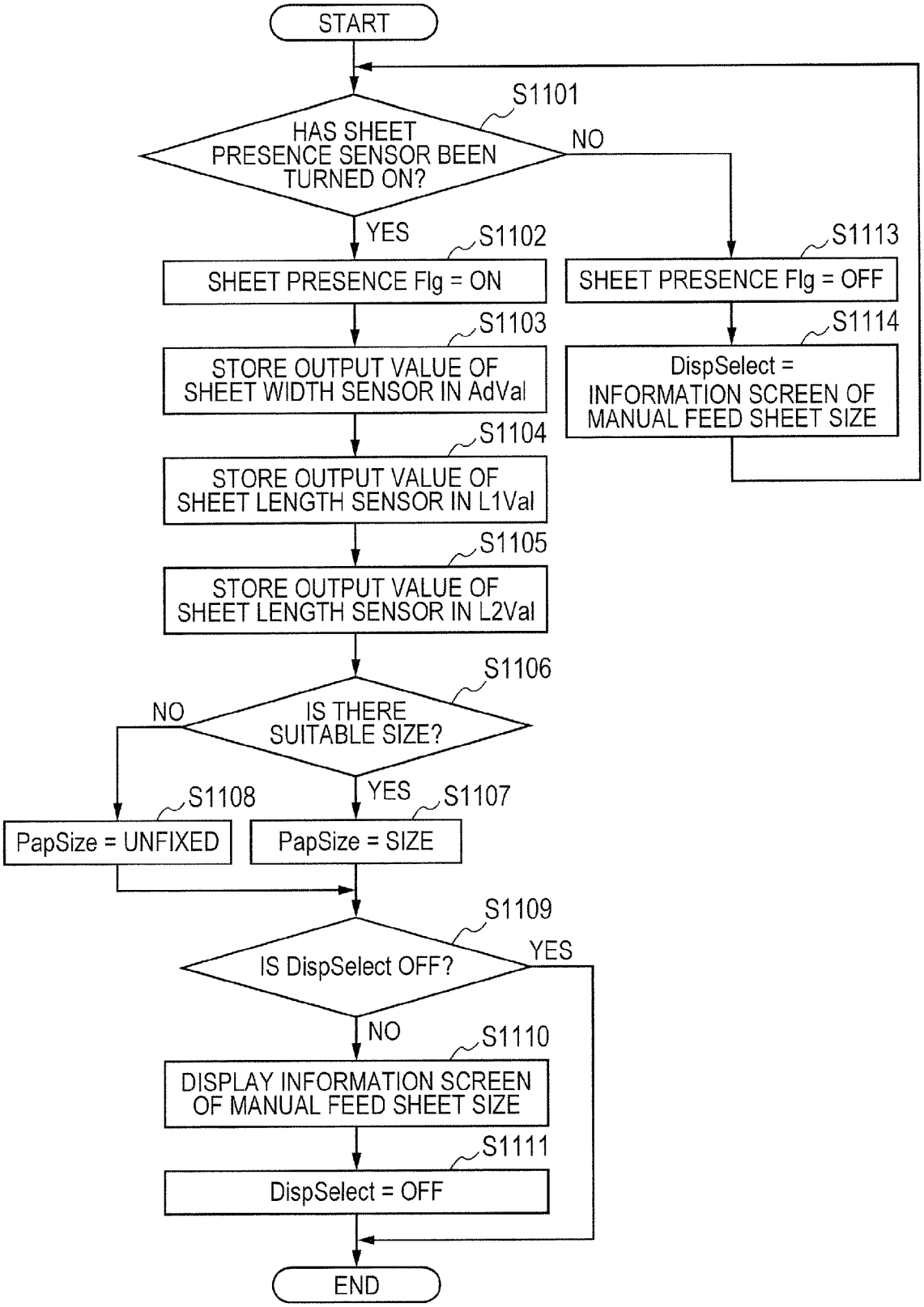
FIG. 9 is a flowchart for illustrating processing for displaying an information screen of a manual feed sheet size according to the second embodiment.
Figure 10:
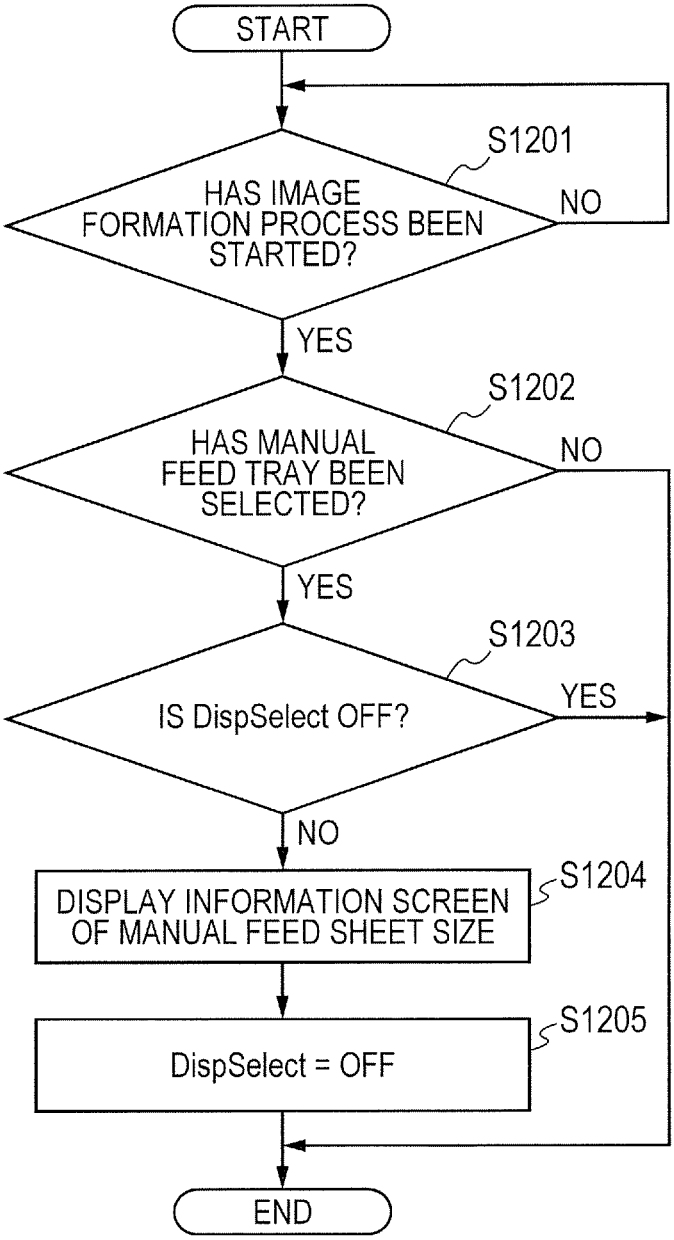
FIG. 10 is a flowchart for illustrating processing performed when image forming processing is started according to the second embodiment.

With reference to FIG. 10, a flowchart for switching the display of the information screen 500 on the display portion 334 of the operation portion 330 by using the variable DispSelect of the RAM 303, in which the information is stored in FIG. 8 and FIG. 9, will be described. The flowchart illustrated in FIG. 10 is executed when the image forming apparatus 100 is operating in the normal mode and when the job is input. Note that, the processing described with reference to FIG. 9 and the processing described with reference to FIG. 10 may be executed in parallel. In S1201, the CPU 301 determines whether or not the image forming processing has been started, and when determining that the image forming processing has not been started, repeats the processing of S1201. When determining in S1201 that the image forming processing has been started, in S1202, the CPU 301 determines whether or not the selected sheet feed unit (recording material feeding unit) is the manual feed tray 210.

When determining in S1202 that the selected sheet feed unit is not the manual feed tray 210, the CPU 301 brings the processing to an end. When determining in S1202 that the selected sheet feed unit is the manual feed tray 210, in S1203, the CPU 301 determines whether or not the variable DispSelect of the RAM 303 is OFF. When determining in S1203 that OFF is stored in DispSelect, the CPU 301 brings the processing to an end. In this case, the CPU 301 determines that the sheet on the manual feed tray 210 has not been changed between the time of shifting to the sleep mode and the time of recovering from the sleep mode.

When determining in S1203 that DispSelect does not store OFF, in S1204, the CPU 301 displays the information screen 500 on the display portion 334 of the operation portion 330. In this case, the sheet on the manual feed tray 210 may have been changed during the sleep mode, and hence the CPU 301 displays the information screen 500 on the display portion 334 of the operation portion 330, to thereby prompt the user to confirm the sheet on the manual feed tray 210. In S1205, the CPU 301 stores OFF in DispSelect, and brings the processing to an end. Note that, when the variable DispSelect of the RAM 303 stores OFF, the information screen 500 is not displayed on the display portion 334 of the operation portion 330.

Here, the following cases are conceivable as the case where DispSelect is OFF.

<Case 1-1>

A case where PapSize is not "unfixed" and it is determined that the sheet of the same size is set on the manual feed tray 210 at the time of shifting to the sleep mode and after the time of recovering from the sleep mode (S1017 in FIG. 8).

<Case 1-2>

A case where the information screen 500 is displayed on the display portion 334 of the operation portion 330 (S1111 of FIG. 9 and S1205 of FIG. 10).

When, as in Case 1-1, it is determined that the sheet on the manual feed tray 210 has not been changed during the sleep mode, the information screen 500 is inhibited from being displayed, to thereby realize an improvement in usability.

On the other hand, the following cases are conceivable as the case where the information for instructing to display the information screen 500 is stored in the variable DispSelect of the RAM 303 instead of OFF.

<Case 2-1>

A case where it is determined that the size of the sheet set on the manual feed tray 210 is different between at the time of shifting to the sleep mode and after the time of recovering from the sleep mode the sleep mode and where the size of the sheet is "unfixed" (YES in S1015 of FIG. 8 and NO in S1016).

<Case 2-2>

A case where the sheet was not set on the manual feed tray 210 when the shift was made to the sleep mode but where the sheet is set on the manual feed tray 210 when the recovery is made from the sleep mode (NO in S1013 of FIG. 8).

<Case 2-3>

A case where the sheet presence sensor 214 detects OFF in the normal mode (NO in S1005 of FIG. 8, and S1114 of FIG. 9).

In particular, in Case 2-1 where it is determined that the sheet on the manual feed tray 210 has been changed during the sleep mode, the information screen 500 is displayed at the timing at which the manual feed tray 210 is selected as the sheet feed unit when the image forming processing is to be executed. With this configuration, the screen for confirming the sheet on the manual feed tray 210 is explicitly displayed at a timing to use the selected sheet, which can prevent the size of the sheet from being erroneously detected as well as improve the usability.

According to the embodiments described above, even when the sheet on the manual feed tray is changed during the sleep mode of the image forming apparatus, it is possible to decide the sheet size after the recovery from sleep, to thereby prevent the image failure and the paper jam.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-141365, filed Jul. 9, 2014, and Japanese Patent Application No. 2015-121169, filed Jun. 16, 2015, which are hereby incorporated by reference herein in their entirety.

What is claimed is:

1. An image forming apparatus, comprising:

a manual feed tray on which a recording material is stacked;

a first detecting unit configured to detect presence or absence of the recording material on the manual feed tray;

a second detecting unit configured to detect a length of the recording material on the manual feed tray in a direction perpendicular to a conveyance direction of the recording material;

a third detecting unit configured to detect a length of the recording material on the manual feed tray in the conveyance direction;

a decision unit configured to decide a size of the recording material based on detection results of the first, the second, and the third detecting units, the image forming apparatus being operable in a first power mode in which power is supplied to the decision unit and a second power mode in which the power is not supplied to the decision unit;

a storage unit configured to store the size of the recording material decided by the decision unit when the image forming apparatus is shifted from the first power mode to the second power mode;

a display unit configured to display information; and a control unit configured to cause the display unit to display a screen for prompting a confirmation of the size of the recording material on the manual feed tray in a case where the first detecting unit has detected the presence of the recording material when the image forming apparatus is shifted from the second power mode to the first power mode and size of the recording material decided by the decision unit when the image forming apparatus is shifted from the second power mode to the first power mode does not match the size of the recording material stored in the storage unit, the control unit causing the screen to be displayed even if the storage unit already stores size information.

2. An image forming apparatus according to claim 1, wherein the control unit causes the display unit to display the screen in a case where the storage unit stores information indicating that there is no recording material on the manual feed tray before the image forming apparatus is shifted from the first power mode to the second power mode despite that the first detecting unit detects that there is a recording material on the manual feed tray after the image forming apparatus is shifted from the second power mode to the first power mode.

3. An image forming apparatus according to claim 1, wherein the control unit causes the display unit to display the screen on when the decision unit fails to decide the size of the recording material after the image forming apparatus is shifted from the second power mode to the first power mode.

4. An image forming apparatus according to claim 1, wherein in a case where the screen is to be displayed on the display unit, the control unit causes the display unit to display the screen when the image forming apparatus is shifted from the second power mode to the first power mode.

5. An image forming apparatus according to claim 1, wherein in a case where the screen is to be displayed on the display unit, the control unit causes the display unit to display the screen when the manual feed tray is designated as a recording material feeding unit in a job which is inputted after the image forming apparatus is shifted from the second power mode to the first power mode.

6. An image forming apparatus according to claim 1, wherein in a case where the first detecting unit has detected the presence of the recording material when the image forming apparatus is shifted from the second power mode to the first power mode and the size of the recording material decided by the decision unit when the image forming apparatus is shifted from the second power mode to the first power mode matches the size of the recording material stored in the storage unit, the control unit prevents the display unit from displaying the screen.

7. An image forming apparatus according to claim 1, wherein the manual feed tray comprises regulating plates configured to regulate both end portions of the recording material in the direction perpendicular to the conveyance direction, and the second detecting unit outputs a value corresponding to positions of the regulating plates in association with operations of the regulating plates.

8. An image forming apparatus according to claim 1, wherein the decision unit decides the size of the recording material based on the detection results of the first, the second, and the third detecting unit and information obtained by associating the detection results of the first, the second, and the third detecting unit with the sizes of the recording material.

9. An image forming apparatus according to claim 1, further comprising a monitor unit configured to monitor an occurrence of a factor that causes a shift to the first power mode when the image forming apparatus is operated in the second power mode, wherein the monitor unit executes an operation of shifting the image forming apparatus from the second power mode to the first power mode when the factor occurs.

10. An image forming apparatus according to claim 9, further comprising a button configured to be pressed in order to shift the second power mode to the first power mode, wherein the factor comprises a fact that the button has been pressed.

11. An image forming apparatus according to claim 9, wherein the image forming apparatus is connected to a network configured to communicate with an external apparatus, and the factor comprises a fact that a job has been input from the external apparatus through the network.

12. An image forming apparatus according to claim 9, wherein the image forming apparatus is connected to a telephone line configured to receive a facsimile; and the factor comprises a fact that the facsimile has been received through the telephone line.

13. An image forming apparatus according to claim 1, wherein the first power mode is a mode for executing an image forming operation; and the second power mode is a mode in which power consumption is reduced to a lower level than in the first power mode.

* * * * *